United States Patent [19]

Artemenko et al.

[11] Patent Number: 4,771,770

[45] Date of Patent: Sep. 20, 1988

[54] MOISTURE AND HEAT EXCHANGE DEVICE FOR AN OXYGEN SELF-CONTAINED BREATHING APPARATUS

[75] Inventors: Anatoly I. Artemenko; Ljubov A. Zborschik; Vladimir K. Kocherga; Viktor N. Luchko; Anatoly E. Margolis; Vladimir K. Ovcharov; Jury A. Shevchenko; Boris I. Baskakov, all of Donetsk, U.S.S.R.

[73] Assignee: Vsesojuzny Nauchno-Issledovatelsky institut Gornospasatelnogo Dela, Donetsk, U.S.S.R.

[21] Appl. No.: 758,499

[22] Filed: Jul. 24, 1985

[30] Foreign Application Priority Data

Nov. 26, 1984 [SU] U.S.S.R. ..... 3812151

[51] Int. Cl.[4] ..... A62B 18/08

[52] U.S. Cl. ..... 128/201.13; 128/202.26; 128/203.26; 128/204.17

[58] Field of Search ..... 128/201.17, 203.16, 128/203.26, 204.13, 204.14, 204.17; 55/257 HE, 207, 387; 261/152–157

[56] References Cited

U.S. PATENT DOCUMENTS

| | | | |
|---|---|---|---|
| 3,650,269 | 3/1972 | Curtis | 128/204.15 |
| 3,747,598 | 7/1973 | Cowans | 128/201.13 |
| 3,920,009 | 11/1975 | Olsen | 128/201.13 |
| 4,090,513 | 5/1978 | Togawa | 128/201.13 |
| 4,168,706 | 9/1979 | Lovell | 128/204.16 |
| 4,201,206 | 5/1980 | Kuehn et al. | 128/201.13 |
| 4,300,547 | 11/1981 | Pasternack | 128/204.15 |
| 4,484,938 | 11/1984 | Okamoto | 55/387 |

FOREIGN PATENT DOCUMENTS

| | | | |
|---|---|---|---|
| 56-53381 | 12/1981 | Japan | 128/201.13 |
| 201960 | 2/1966 | Sweden | 128/201.13 |
| 409462 | 11/1977 | U.S.S.R. | 128/202.26 |

*Primary Examiner*—William E. Kamm
*Assistant Examiner*—K. M. Reichle
*Attorney, Agent, or Firm*—Burgess, Ryan and Wayne

[57] ABSTRACT

A moisture and heat exchange device for a regeneration type oxygen self-contained breathing apparatus comprises a casing having pipes of which one pipe is connected to a facepiece of the apparatus and the other pipe is connected to a regenerating cartridge of the apparatus. The casing houses a multiple-layer package of alternating hydrophilic and hydrophobic washers, disposed coaxially with the casing. The hydrophilic washers of the multiple-layer package are made in the form of nets of a fibrous material impregnated with a hygroscopic substance. The hydrophobic washers of the multiple-layer package are made of a non-woven bulk web having a linear density which is lower than the linear density of the material of the hydrophilic washers. Two air-distribution pressure screens are provided at the end faces of the multiple-layer package to engage the hydrophobic washers.

2 Claims, 2 Drawing Sheets

MOISTURE AND HEAT EXCHANGE DEVICE FOR AN OXYGEN SELF-CONTAINED BREATHING APPARATUS

FIELD OF THE ART

The invention relates to a component of a regenerating typ self-contained breathing apparatus, and more particularly, to a moisture and heat exchange device of a regeneration type self-contained breathing apparatus.

The invention finds application in regeneration type self-contained breathing apparatus used in the mining industry for protecting the respiratory organs under unfavourable conditions, in the chemical and other industries where short-time protection of respiratory organs of a human being is required.

BACKGROUND OF THE INVENTION

A widely known moisture and heat exchange device for a breathing respiratory apparatus in the form of a breathing gas conditioner (cf. U.S. Pat. No. 3,747,598, Int. Cl. A62 B 7/06, 1970) comprises hydrophobic elements in the form of copper wire nets exhibiting high heat conductance and hydrophilic elements or hygroscopic means in the form of activated molecular sieve means therebetween. In this moisture and heat exchange apparatus the exhaled air passes through the multiple-layer package of hydrophobic and hydrophilic elements in the form of the nets and molecular sieves. The exhaled air is dried owing to adsorption of water vapour in the porous structure of the hydrophilic elements. The inhaled air passes through the multiple-layer package of hydrophobic and hydrophilic elements and is cooled by transfer of the part of heat to the hydrophobic members or copper wire nets and to evaporation of moisture adsorbed by the hydrophilic elements in the form of molecular sieves. This results in moistening of the inhaled air.

The above described moisture and heat exchange device for a breathing apparatus exhibits a low efficiency since by the end of operation of the apparatus, as the temperature of the hydrophilic elements, in the form of molecular sieves increases, physical adsorption of moisture in the hydrophilic elements is impaired and the air flow is redistributed as a result of the non uniform saturation of the hydrophilic elements adsorbent with moisture.

Another widely known moisture and heat exchange device for a breathing apparatus (cf. Japanese patent specification Nos. 56-53381, Int. Cl. A. 61 M/16/00, A62 B 7/00, 1977) comprises a casing in the form of a tubular member accomodating a multiple-layer package of alternating hydrophobic elements in the form of metal heat conducting members and hydrophilic elements in the form of moisture-adsorbing heat insulating members. The hydrophobic and hydrophilic elements in this device are made in the form of washers. The hydrophobic elements are made of braided metal nets.

The abovedescribed moisture and heat exchange device for a breathing apparatus exhibits low efficiency owing to impaired conditions for the flow of inhaled and exhaled air through and around the hydrophobic elements in the form of heat conducting metal fibers. This is due to the fact that the process of heating and cooling of the hydrophobic elements is a long-term process and the time of heat exchange between the inhaled and exhaled air on the one side and the hydrophobic elements on the other during inhalation and exhalation is short (from 0.3 to 0.5 s). Since the heat conducting members of a breathing apparatus are heated to the maximum extent by the end of operation of the apparatus, and their temperature is close to that of the air admitted from a breathing bag, this time is not long enough for efficient cooling of the inhaled air.

Conditions for the flow of inhaled and exhaled air around the heat insulating fibers of the hydrophilic elements impregnated with a chemical adsorbent are also impaired, an increase in the adsorbent temperature having no effect on the moisture adsorbing capacity. Such adsorbent, applied to a support in the form of a washer made of a fibrous material, include hygroscopic salts such as $CaCl_2$, LiCl, $ZnCl_2$ which form crystallohydrates when adsorbing moisture. A layer of a solution of the hygroscopic substance is formed on the surface of the hydrophilic elements and covers the pores of both the hydrophilic elements and the adjacent hydrophobic elements. Clogging of pores of the hydrophobic and hydrophilic elements with a solution of the hygroscopic substance results in a redistribution of the air flow and non-uniform absorption by the adsorbent on the hydrophilic elements.

SUMMARY OF THE INVENTION

It is an object of the invention to improve efficiency of a moisture and heat exchange device for a regenerating type oxygen self-contained breathing apparatus by improving conditions for the flow of inhaled and exhaled air around fibers of hydrophilic and hydrophobic washers during the time of operation of the apparatus.

This is achieved by a moisture and heat exchange device for a regenerating oxygen self-contained breathing apparatus, comprising a casing having pipes of which one pipe is connected to a facepiece of the apparatus and the other pipe is connected to a regenerating cartridge of the apparatus, and a multiple-layer package including alternating hydrophilic and hydrophobic washers accommodated in the casing coaxially therewith, according to the invention, the hydrophilic washers of the multiple-layer package are made in the form of nets of a fibrous material impregnated with a hygroscopic substance, the hydrophobic washers of the multiple-layer package are made of a non-woven bulk web having a linear density which is lower than the linear density of the material of the hydrophilic washers, and there are also provided two air-distribution pressure screens installed at the end faces of the multiple-layer package and engaging the hydrophobic washers.

To ensure uniform operation of the hydrophilic elements in the course of redistribution of the air flow, at least one of the air-distribution screens is preferably made with a mesh of the screen increasing in the direction from the axis toward the periphery.

This construction of a moisture and heat exchange device for an oxygen self-contained breathing apparatus improves efficiency of its operation owing to improved conditions for the air flow around fibers of the hydrophilic and hydrophobic washers since their pores are not clogged with a solution of crystallohydrate formed during adsorption of moisture by the adsorbent of the hydrophilic washers.

BRIEF DESCRIPTION OF THE DRAWINGS

The invention will be described with reference to the accompanying drawings illustrating specific embodiments of the invention, in which.

DETAILED DESCRIPTION OF THE INVENTION

Figure 1:
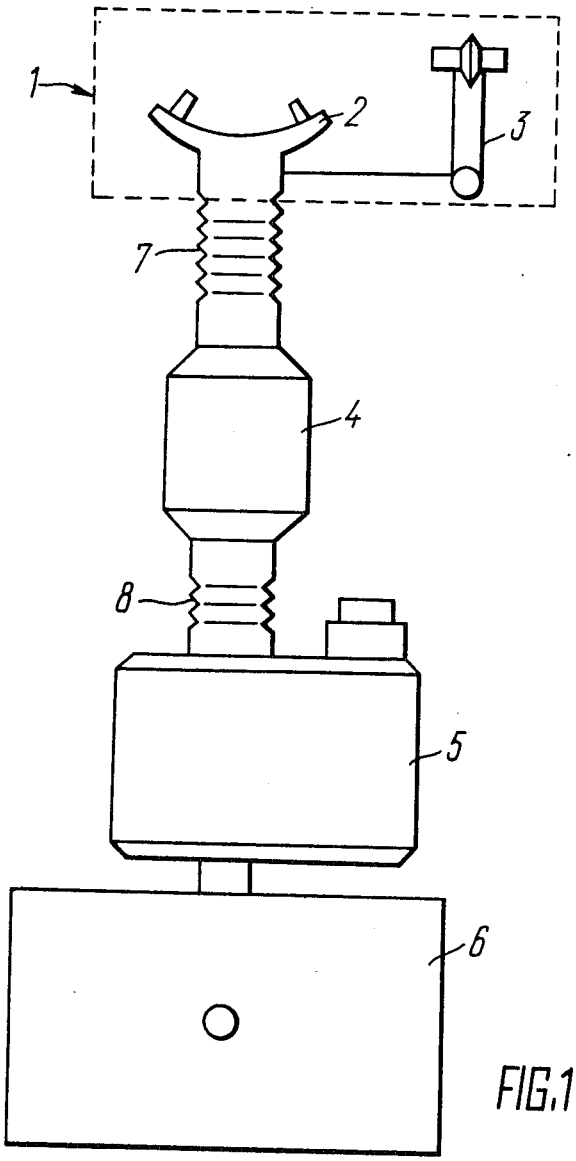
FIG. 1 is a diagrammatic view of an oxygen self-contained breathing apparatus based on pendulum air circulation, according to the invention.

An oxygen self-contained breathing apparatus, based on pendulum air circulation comprises a facepiece 1 (FIG. 1) for application to be face so as to cover the respiratory organs of a human being, which includes a mouthpiece 2 with a nose clamp 3, the facepiece being connected to a moisture and heat exchange device 4, a regenerating cartridge 5 containing an oxygen generating chemical such as potassium superoxide $KO_2$ connected to a breathing bag 6. The moisture and heat exchange device 4 is connected to the facepiece 1 of the apparatus by means of a flexible pipe 7. The regenerating cartridge 5 is connected to the moisture and heat exchange device 4 by means of a flexible pipe 8.

Figure 2:
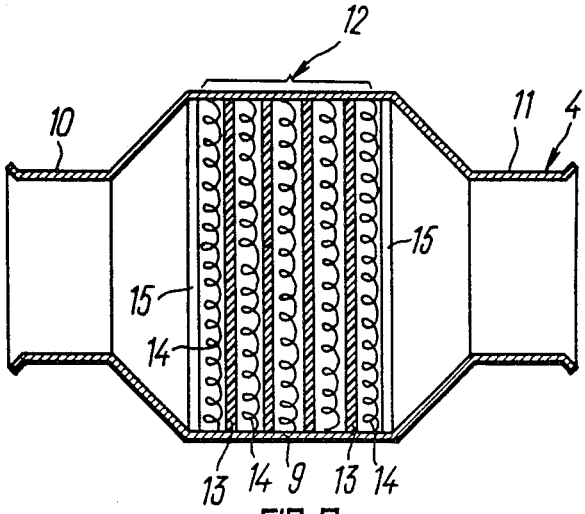
FIG. 2 is a longitudinal section view of a moisture and heat exchange device for an oxygen self-contained breathing apparatus, according to the invention.

The moisture and heat exchange device 4 is made in the form of a cylindrical casing 9 (FIG. 2) having pipes 10 and 11. The pipe 10 connects to the facepiece 1 of the apparatus and is designed for supplying exhaled air. The pipe 11 connects to the regenerating cartridge 5 (FIG. 1) and is designed for supplying dry and heated regenerated air. A multiple-layer package 12 is accommodated in the casing 9 (FIG. 2) coaxially therewith and consists of hydrophilic washers 13 and hydrophobic washers 14. The multiple-layer package 12 is mounted in the casing 9 between two air-distribution pressure screens 15 engaging the hydrophobic washers 14.

The hydrophilic washers 13 and the hydrophobic washers 14 are made of fiberous polymer materials featuring a very low heat conductivity (in range of 0.02 to 10.9 Kcal/nb°C.). The hydrophilic washers 13 are made in the form of braided cotton fiber nets, i.e. of gauze and are impregnated with a hygroscopic solution, e.g. of calcium chloride. The linear density of the material of the hydrophilic washers is within the range from 19 to 35 tex. The hydrophobic washers 14 are made of a non-woven (jet-spun) web made of Lavsan fibers. The web of the hydrophobic washers 14 has a linear density of from 0.7 to 2 tex, i.e. this web is much more porous as compared with the material of the hydrophilic washers 13.

Use of the hydrophobic washers 14 made of non-woven web manufactured from a polymer fibrous material exhibiting a low heat conductance ensures good heat exchange between air passing by in a matter of fractions of a second and fibers of the hydrophobic washer 14 having a large surface area. Since the material of the hydrophobic washers 14 has a low heat conductance, heating and cooling of their fibers is not connected with inertia. The fact that fibers of the hydrophobic washers 14 will never be heated up to a temperature at which condensation of moisture is interrupted contributes to air cooling by using its heat for evaporation of the moisture.

The multiple-layer package 12 consists of alternating hydrophilic washers 13 and hydrophobic washers 14 arranged in such a manner that the hydrophobic washers 14 remain exposed at the end faces of the package so as to engage the air-distribution pressure screens 15. The air-distribution screens 15 can be made of a woven wire net having the wires made of a material that withstands corrosion, e.g., of stainless steel.

Figure 3:
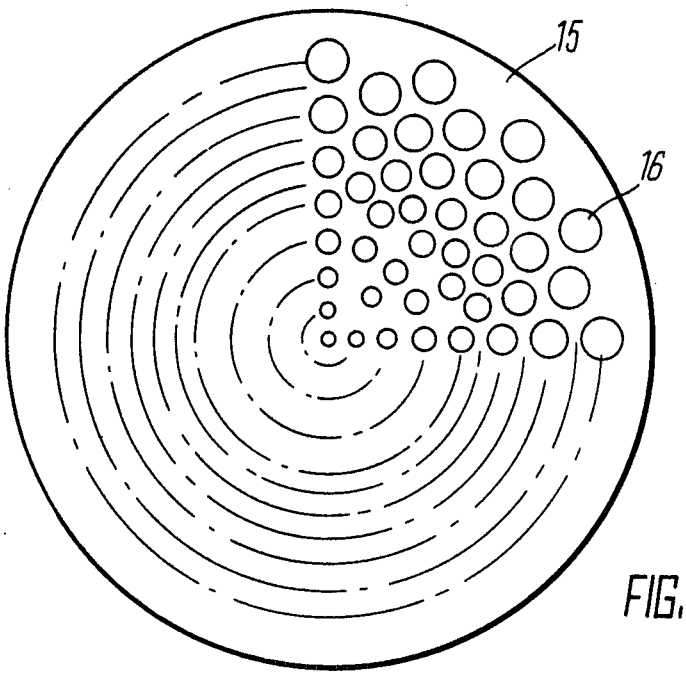
FIG. 3 is a plan view of an air-distribution pressure screen according to the invention.

At least one of the air-distribution pressure screens 15 is preferably made in the form of a perforated disc (FIG. 3) having its meshes (orifices) 16 increasing in size in the direction from the center towaard the periphery. With such a construction of the air-distribution pressure screen 15, the aerodynamic resistance of the meshes decreases in the direction from the center of the disc toward the periphery. The most optimal embodiment is one in which the law of change in the aerodynamic resistance of the air-distribution pressure screen 15 in the direction from the center toward the periphery corresponds to the parabolic law of distribution of velocities of the air flow. This makes it possible to ensure uniform distribution of air flow among all zones of the multiple-layer package 12 thereby improving conditions for the flow of air around fibers of the hydrophilic and hydrophobic washers 13, 14 and to enhance efficiency of heat exchange.

EXAMPLE

For a 90 minutes breathing apparatus having a regenerating cartridge incorporating 2.1 Kg of an oxygen-generating chemical ($KO_2$), the moisture and heat exchange device comprised nine washers 58 mm in diameter. Four washers were the hydrophilic washers 13 weighing 0.4 g each and five, the hydrophobic washers 14 of a mass of 0.2 g each. The thickness of the multiple-layer package 12 was 12–13 mm. Aerodynamic resistance of the multiple-layer package 12 for an air flow of 60 l/min was at most 4 mm $H_2O$. One of the air-distribution pressure screens 15 was made of a wire net having 16 meshes of $3\times3$ mm. The other air-distribution pressure screen 15 was arranged in coaxial rows in the form of a disc having orifices 16 of a diameter increasing from 1.5 mm in the central zone to 6 mm at the periphery of the disc.

The moisture and heat exchange device of an oxygen self-contained breathing apparatus functions in the following manner.

Upon exhalation, air passes through the pipe 7 (FIG. 1) toward the moisture and heat exchange device 4 and then through the pipe 8 toward the regenerating cartridge 5 where carbon dioxide is adsorbed, whereafter the air is admitted to the breathing bag 6. During inhalation, air from the breathing bag 6 passes through the regenerating cartridge 5, pipe 8, moisture and heat exchange device 4 and pipe 7 to the facepiece 1 of the apparatus.

The exhaled air contains carbon dioxide; it has a relative humidity of 94–98% and a temperature between 36.0° and 37.0° C. Moving along the pipe 10 from the facepiece 1 of the apparatus, the air passes through the multiple-layer package 12 (FIG. 2) wherein it is dried by absorpiton of moisture by the hygroscopic substance of the hydrophilic washers 13. During absorption of moisture, the hygroscopic substances form crystallohydrates. As water vapour is absorbed, the amount of a solution of the hygroscopic substance on the hydrophilic washers 13 increases, and the solution of the hygroscopic substance overflows to fibers of the adjacent hydrophobic washers 14. A part of moisture from the exhaled air is condensed on fibers of the hydrophobic washers 14.

In the regenerating cartridge 5 (FIG. 1) to which the exhaled air is admitted from the moisture and heat exchange device 4, exothermic reactions occur with the carbon dioxide and residual moisture, the reactions proceed with the adsorption of carbon dioxide and release of heated oxygen. When a human being inhales, air from the regenerating cartridge 5 flows through the pipe 11 to the moisture and heat exchange device 4. This air enters the exchange device 4 dry and heated at 70°-90° C. When the air inhaled by the human being passes through the multiple-layer package 12 (FIG. 2), it is moistened and cooled because a certain amount of heat is required to evaporate moisture from fibers of the hydrophilic washers 13 and hydrophobic washers 14. A part of heat in the air leaving the regenerating cartridge 5 (FIG. 1) is spent heating the multiple-layer package 12 (FIG. 2) and casing 9 of the moisture and heat exchange device 4 and the heat is radiated into the environment.

Since the hydrophilic washers 13 and hydrophobic washers 14 in the multiple-layer package 12 intimately engage one another and the air-distribution pressure screens 15, the solution of crystallohydrate can flow to fibers of the adjacent member irrespective of position (horizontal, vertical or inclined) of the moisture and heat exchange device 4 when the apparatus is used. This makes efficiency of the moisture and heat exchange device 4 independent of its position in space.

The characteristics of the efficiency of the moisture and heat exchange device 4 of an oxygen self-contained breathing apparatus is a low temperature of inhaled air and absence of dryness in the mouth of a human being. In the apparatus described above the moisture and heat exchange device 4 ensures that the temperature of inhaled air of 30° C. at the beginning is the protective operation and not higher than 45° C. by the end of the effective protective period. Therefore, a human being can inhale the air at a temperature which is lower than the temperature of exhaled air, and slightly heated air is inhaled by the time the regenerating device is spent.

The moisture and heat exchange device for an oxygen self-contained breathing apparatus features a simple structure, low manufacturing cost and high efficiency in operation, and it can ensure comfortable breathing condition. Improved breathing conditions of a human being prevent rapid fatigue so as to permit to a human being to escape from dangerous zones more rapidly.

We claim:

1. A moisture and heat exchange device for a regenerative self-contained breathing apparatus, comprising:

a casing having two pipe openings; the first pipe of said casing adapted to be connected to a facepiece of the apparatus; the second pipe of said casing adapted to be connected to a regenerating cartridge of the apparatus;

a multiple-layer package of alternating hydrophilic and hydrophobic washers arranged in said casing coaxially therewith, said hydrophobic washers being disposed at the end faces of the package; said hydrophilic washers of said multiple-layer package formed of nets of a fibrous material of low heat conductivity having a linear density impregnated with a hygroscopic substance; said hydrophobic washers of said multiple-layer package formed of a non-woven web of a fibrous material of low heat conductance, said web having a linear density which is lower than the linear density of the material of said hydrophilic washers; two air-distribution pressure screens being disposed at the end faces of said multiple-layer package to engage said hydrophobic washers disposed at the end faces of said multiple-layer package.

2. A moisture and heat exchange device of claim 1 for an oxygen self-contained breathing apparatus, wherein at least one of said air-distribution screens is made with openings, the areas of which increases from the center toward the periphery.

* * * * *